US008209915B2

(12) United States Patent
O'Leary et al.

(10) Patent No.: US 8,209,915 B2
(45) Date of Patent: Jul. 3, 2012

(54) WALL CONSTRUCTION AIR BARRIER SYSTEM

(75) Inventors: Robert J. O'Leary, Newark, OH (US); Michelle L. Korwin-Edson, Pataskala, OH (US); Michael T. Pellegrin, Newark, OH (US)

(73) Assignee: Owens Corning Intellectual Capital, LLC, Toldeo, OH (US)

( * ) Notice: Subject to any disclaimer, the term of this patent is extended or adjusted under 35 U.S.C. 154(b) by 447 days.

(21) Appl. No.: 11/933,344

(22) Filed: Oct. 31, 2007

(65) Prior Publication Data

US 2009/0107066 A1 Apr. 30, 2009

(51) Int. Cl.
*E04B 1/68* (2006.01)

(52) U.S. Cl. ..... 52/62; 52/293; 52/61

(58) Field of Classification Search ..... 52/293.3, 52/58, 272–274, 61, 62, 408
See application file for complete search history.

(56) References Cited

U.S. PATENT DOCUMENTS

| | | | | |
|---|---|---|---|---|
| 3,617,198 | A | | 11/1971 | Reid et al. |
| 3,673,133 | A | | 6/1972 | Schmidt |
| 3,714,078 | A | | 1/1973 | Gordon et al. |
| 3,768,969 | A | | 10/1973 | Kullman et al. |
| 3,913,298 | A | | 10/1975 | Cogliano |
| 3,992,558 | A | | 11/1976 | Smith-Johannsen et al. |
| 4,205,103 | A | | 5/1980 | Davis et al. |
| 4,244,901 | A | | 1/1981 | Wencley et al. |
| 4,306,548 | A | | 12/1981 | Cogliano |
| 4,350,774 | A | | 9/1982 | Scotti et al. |
| 4,408,018 | A | | 10/1983 | Bartman et al. |
| 4,430,832 | A | | 2/1984 | Kaiser et al. |
| 4,644,014 | A | | 2/1987 | Thomson et al. |
| 4,759,956 | A | | 7/1988 | Amer et al. |
| 5,165,915 | A | | 11/1992 | Tokubo et al. |
| 5,217,665 | A | | 6/1993 | Lim et al. |
| 5,218,793 | A | * | 6/1993 | Ball ..... 52/62 |
| 5,359,816 | A | | 11/1994 | Iacouides |
| 5,398,471 | A | * | 3/1995 | Spagnolo ..... 52/412 |
| 5,505,344 | A | | 4/1996 | Woods |
| 5,585,412 | A | | 12/1996 | Natoli et al. |
| 5,741,823 | A | | 4/1998 | Hsu |

(Continued)

FOREIGN PATENT DOCUMENTS

EP 1 593 727 A1 11/2005

(Continued)

OTHER PUBLICATIONS

International Search Report dated May 2, 2008 in PCT/US2007/026433.

(Continued)

*Primary Examiner* — William Gilbert
*Assistant Examiner* — Patrick Maestri
(74) *Attorney, Agent, or Firm* — MacMillan, Sobanski & Todd, LLC

(57) ABSTRACT

A wall construction air barrier system includes a foundation structure and a frame structure positioned on top of the foundation structure. The frame structure has an exterior surface and the frame structure includes a sill plate. At least one exterior sheathing is attached to the frame structure. The exterior sheathing has an interior surface. A continuous sealing gasket has a lateral portion positioned between the sill plate and the foundation structure and an extension portion positioned between the exterior surface of the frame structure and the interior surface of the exterior sheathing.

13 Claims, 8 Drawing Sheets

U.S. PATENT DOCUMENTS

| | | | | |
|---|---|---|---|---|
| 5,802,779 | A * | 9/1998 | Hulls et al. | 52/101 |
| 5,883,182 | A | 3/1999 | Hunt | |
| 6,071,580 | A | 6/2000 | Bland et al. | |
| 6,291,536 | B1 | 9/2001 | Taylor | |
| 6,296,795 | B1 | 10/2001 | Buck | |
| 6,298,619 | B1 * | 10/2001 | Davie | 52/293.3 |
| 6,414,044 | B2 | 7/2002 | Taylor | |
| 6,546,679 | B1 * | 4/2003 | Bushberger | 52/169.14 |
| 6,578,332 | B2 * | 6/2003 | Bushberger | 52/293.3 |
| 6,676,779 | B2 * | 1/2004 | Hopkins et al. | 156/71 |
| 6,797,736 | B1 | 9/2004 | Smiecinski et al. | |
| 6,948,287 | B2 | 9/2005 | Korn | |
| 7,005,457 | B2 | 2/2006 | Loh et al. | |
| 7,053,131 | B2 | 5/2006 | Ko et al. | |
| 2003/0118822 | A1 | 6/2003 | Jahns et al. | |
| 2004/0148889 | A1 | 8/2004 | Bibee et al. | |
| 2005/0043423 | A1 | 2/2005 | Schmidt et al. | |
| 2005/0079352 | A1 | 4/2005 | Glorioso et al. | |
| 2005/0081994 | A1 | 4/2005 | Beckley | |
| 2005/0188649 | A1 | 9/2005 | Hagen, Jr. | |
| 2006/0047010 | A1 | 3/2006 | O'Leary | |
| 2006/0083762 | A1 | 4/2006 | Brun et al. | |
| 2006/0219350 | A1 | 10/2006 | Bain et al. | |
| 2006/0272280 | A1 | 12/2006 | Romes et al. | |
| 2007/0234649 | A1 | 10/2007 | Near et al. | |
| 2008/0160203 | A1 | 7/2008 | O'Leary et al. | |
| 2008/0281006 | A1 | 11/2008 | O'Leary et al. | |

FOREIGN PATENT DOCUMENTS

| | | |
|---|---|---|
| EP | 1 640 388 A2 | 3/2006 |
| WO | WO 01/05886 | 1/2001 |
| WO | WO 01/09239 | 2/2001 |
| WO | WO 01/55266 | 8/2001 |
| WO | WO 02/26873 | 4/2002 |
| WO | WO 02/068515 | 9/2002 |
| WO | WO 2006/107342 | 10/2006 |
| WO | WO 2007/060462 | 5/2007 |
| WO | WO 2007/091961 | 8/2007 |
| WO | WO 2007/112799 | 10/2007 |

OTHER PUBLICATIONS

International Search Report dated Apr. 14, 2008 in PCT/US2007/026434.

International Search Report dated Apr. 14, 2008 in PCT/US2007/026435.

* cited by examiner

WALL CONSTRUCTION AIR BARRIER SYSTEM

TECHNICAL FIELD

The present invention relates generally to wall construction and, more particularly, to insulating portions of the wall under construction.

BACKGROUND OF THE INVENTION

Construction of residential or commercial buildings includes outer walls built from vertical and horizontal members. The vertical and horizontal members are typically wood or metal. The vertical and horizontal members are combined into a frame structure. The frame structure can be constructed on top of a floor structure or the frame structure can be built separately from the floor structure and subsequently positioned on top of the floor structure. An insulating member is typically positioned between the foundation and the frame structure. The insulating member is intended to prevent the flow of air from passing between the foundation and the floor structure.

An exterior sheathing is attached to the exterior of the frame structure. The exterior sheathing provides structural rigidity to the frame structure. The exterior sheathing is typically made of oriented strand board (OSB), waferboard or plywood panels. An exterior air barrier is applied to the exterior sheathing. The exterior air barrier is configured to prevent the flow of air through the frame structure. The exterior air barrier is typically a spunbonded olefin or other synthetic material made of high-density polyethylene fibers.

The purpose of the exterior air barrier is to reduce the flow of air through the frame structure. It would be advantageous if an improved air barrier system could be provided for wall construction.

SUMMARY OF THE INVENTION

According to this invention there is provided a wall construction air barrier system. The wall construction air barrier system includes a foundation structure and a frame structure positioned on top of the foundation structure. The frame structure has an exterior surface and the frame structure includes a sill plate. At least one exterior sheathing is attached to the frame structure. The exterior sheathing has an interior surface. A continuous sealing gasket has a lateral portion positioned between the sill plate and the foundation structure and an extension portion positioned between the exterior surface of the frame structure and the interior surface of the exterior sheathing.

According to this invention there is also provided a wall construction air barrier system. The wall construction air barrier system includes a foundation structure and a frame structure positioned on top of the foundation structure. The frame structure has an exterior surface. At least one exterior sheathing is attached to the exterior surface of the frame structure. The exterior sheathing has an exterior surface. An air barrier is attached to the exterior surface of the exterior sheathing. The air barrier has an interior surface. A continuous sealing gasket has a lateral portion positioned between the sill plate and the foundation structure and an extension portion positioned between the exterior surface of the exterior sheathing and the interior surface of the air barrier.

According to this invention there is also provided a wall construction air barrier system. The wall construction air barrier system includes a frame structure having an interior and exterior surface. The frame structure includes at least one top plate. At least one interior panel is attached to the interior surface of the frame structure. The interior panel has a top edge. At least one ceiling panel extends from the at least one interior panel. The intersection of the at least one ceiling panel and the at least one interior panel form a joint. At least one exterior sheathing is attached to the exterior surface of the frame structure. The exterior sheathing has an interior surface. A sealing member is positioned over the joint. A continuous sealing gasket has a lateral portion and an extension portion. The lateral portion is positioned on top of the sealing member and the extension portion is positioned between the exterior surface of the frame structure and the interior surface of the exterior sheathing.

According to this invention there is also provided a method of constructing a wall air barrier system. The method includes the steps of providing a foundation structure, providing a continuous sealing gasket, the sealing gasket having a lateral portion and an extension portion, positioning the lateral portion of the sealing gasket on the foundation structure, providing a frame structure, attaching the frame structure to the foundation structure such that the lateral portion of the sealing gasket is between the frame structure and the foundation structure, pivoting the extension portion of the sealing gasket into a substantially vertical position, and attaching at least one exterior sheathing to the frame structure such that the extension portion of the sealing gasket is between the exterior sheathing and the frame structure.

According to this invention there is also provided a wall construction air barrier system. The wall construction air barrier system includes a frame structure configured to form a wall. A window opening is positioned within the wall. The window opening has a top opening, a bottom opening and opposing side openings. At least one exterior sheathing is attached to the frame structure. The exterior sheathing has an exterior surface. At least one continuous sealing gasket having a lateral portion is positioned to cover the top opening and an extension portion is positioned on the exterior surface of the exterior sheathing.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

DETAILED DESCRIPTION OF THE INVENTION

Figure 1:
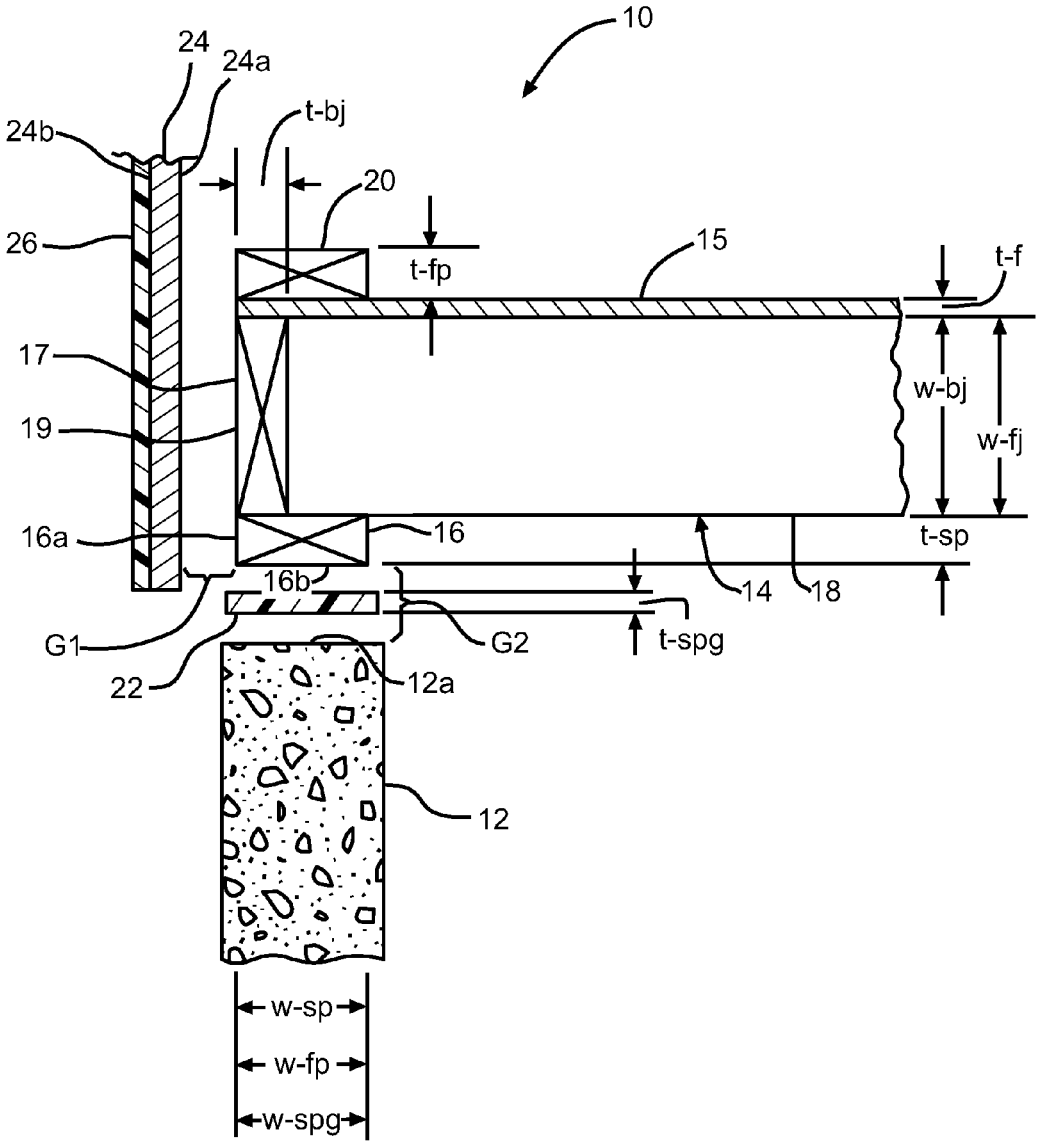
FIG. 1 ( Prior Art)
FIG. 1 is a cross sectional view of a wall construction system.

Referring now to the drawings, there is illustrated in FIG. 1 an example of a wall construction system, indicated generally at 10. As shown in FIG. 1, the wall construction system 10 includes a foundation 12. The foundation 12 is configured to provide a surface for additional structural components, such as for example walls and floors. In the illustrated embodiment, the foundation 12 is a poured concrete wall having a nominal thickness of 8.0 inches. In another embodiment, the foundation 12 can have a nominal thickness of more or less than 8.0 inches. In another embodiment, the foundation 12 can be made from other materials, such as for example concrete block or treated structural wood sufficient to provide a surface for additional structural components. The foundation 12 has a foundation top 12*a*.

As shown in FIG. 1, the wall construction system 10 includes a frame structure 14. The frame structure 14 is configured to define interior space within the building and to support additional structural components. In the illustrated embodiment, the frame structure 14 is constructed on the top of the foundation 12.

The frame structure 14 includes sill plates 16, band joists 17, floor joists 18, and floor plates 20. In the illustrated embodiment, the sill plates 16 are substantially horizontal members configured to provide surfaces to which additional framing members are attached. In the illustrated embodiment, the sill plates 16 are made of pressure treated wood. The pressure treated wood is configured to resist decay and insects. In another embodiment, the sill plates 16 can be made of other materials, such as for example untreated wood or metal, sufficient to provide surfaces to which additional framing members can be attached.

As shown in FIG. 1, the sill plates 16 have a nominal thickness t-sp and a nominal width w-sp. In the illustrated embodiment, the nominal thickness t-sp is 2 inches and the nominal width w-sp is 6 inches. In another embodiment, the sill plates 16 can have a nominal thickness t-sp of more or less than 2 inches and a nominal width w-sp of more or less than 6 inches.

In the illustrated embodiment, the sill plates 16 are anchored to the foundation structure 12. In another embodiment, the sill plates 16 can simply rest on the foundation structure 12. The sill plates 16 have an exterior surface 16*a* and a bottom surface 16*b*.

As shown in FIG. 1, the band joists 17 and the floor joists 18 are configured to attach to the sill plates 16 and provide support for additional structural components. In the illustrated embodiment, the band joists 17 and the floor joists 18 are made of wood. In another embodiment, the band joists 17 and the floor joists 18 can be other materials, such as for example metal, sufficient to provide support for additional structural components. The band joists 17 have a nominal thickness t-bj and a nominal width w-bj. In the illustrated embodiment, the nominal thickness t-bj is approximately 2 inches and the nominal width w-bj is approximately 6 inches. In another embodiment, the band joists 17 can have a nominal thickness t-bj of more or less than 2 inches and a nominal width w-bj of more or less than 6 inches. Similarly, the floor joists 18 have a nominal thickness (not shown) and a nominal width w-fj. In the illustrated embodiment, the nominal thickness of the floor joists 18 is approximately 2 inches, the nominal width w-fj is approximately 6 inches. In another embodiment, the floor joists 17 can have a nominal thickness of more or less than 2 inches and a nominal width w-fj of more or less than 6 inches.

While not shown in FIG. 1, it is to be understood that a plurality of spaced apart substantially horizontal framing braces may be positioned between the frame structures 14. The horizontal framing braces are configured to provide support to the frame structure 14.

As shown in FIG. 1, the wall construction system includes floor plates 20. The floor plates 20 are configured to support wall framing studs (not shown). In the illustrated embodiment, the floor plates 20 are made of wood. In another embodiment, the floor plates 20 can be other materials, such as for example metal, sufficient to support wall framing studs. The floor plates 20 have a nominal thickness t-fp and a nominal width w-fp. In the illustrated embodiment, the floor plates 20 have a nominal thickness t-fp of 2 inches and a nominal width w-fp of 6 inches. In another embodiment, the nominal thickness t-fp can be more or less than 2 inches and the nominal width w-fp can be more or less than 6 inches.

Referring again to FIG. 1, the frame structure 14 supports the floor 15. The floor 15 has a thickness t-f. In the illustrated embodiment, the thickness t-f is approximately 0.75 inches. Alternatively, the thickness t-f can be more or less than 0.75 inches. In the illustrated embodiment, the floor 15 is made from oriented strand board (OSB). In another embodiment, the floor 15 can be made of other materials, such as for example plywood.

As shown in FIG. 1, the frame structure 14 has an exterior surface 19. The exterior surface 19 of the frame structure 14 is configured to provide an attachment surface for additional construction materials.

Referring again to FIG. 1, an exterior sheathing 24 is attached to the exterior surface 19 of the frame structure 14. The exterior sheathing 24 is configured to provide rigidity to the wall construction system 10 and also to provide a surface for an exterior wall covering. In the illustrated embodiment, the exterior sheathing 24 is made of oriented strand board (OSB). In another embodiment, the exterior sheathing 24 can be made of other materials, such as for example plywood, waferboard, rigid foam or fiberboard, sufficient to provide rigidity to the wall construction system 10 and to provide a surface for an exterior wall covering. As shown in FIG. 1, the exterior sheathing 24 has an interior surface 24*a* and an exterior surface 24*b*. The exterior sheathing 24 extends to cover the exterior surfaces 19 of the frame structure 14 and the exterior surface 16*a* of the sill plate 16.

As shown in FIG. 1, an intersection between the interior surface 24*a* of the exterior sheathing 24 and exterior surface 16*a* of the sill plate 16 defines a gap G1. For purposes of clarity, the gap G1 and other gaps illustrated in the figures are exaggerated. Accordingly, the illustrated gaps are not representative of the actual size of the gaps.

As further shown in FIG. 1, an air barrier 26 is applied to the exterior surface 24*b* of the exterior sheathing 24. The air barrier 26 is configured to prevent the flow of air through the frame structure 14. In the illustrated embodiment, the air barrier 26 is made of a spunbonded olefin material. One example of an air barrier is PINKWRAP® sold by Owens Corning Corporation headquartered in Toledo, Ohio. In another embodiment, the air barrier can be made of other materials, such as for example synthetic high-density polyethylene fibers sufficient to prevent the flow of air through the frame structure 14. As shown in FIG. 1, the air barrier 26 extends to cover the exterior sheathing 24.

As shown in FIG. 1, a sill plate gasket 22 is positioned between the frame structure 14 and the foundation 12. As shown in FIG. 1, the sill plate gasket 22 fills a second gap G2, defined as the space between the bottom 16*b* of the sill plate 16 and the top 12*a* of the foundation 12. The sill plate gasket 22 is configured to prevent the flow of air through gap G2, thereby sealing out air and insects. In the illustrated embodiment, the sill plate gasket 22 is made of a polyethylene foam material. One example of a sill plate gasket 22 is FoamSealR™ manufactured by Owens Corning Corporation headquartered in Toledo, Ohio. In another embodiment, the sill plate gasket 22 can be made of other materials, such as for example felt or tar paper sufficient to prevent the flow of air through gap G2. The sill plate gasket 22 has a width w-spg. The width w-spg is typically the same width w-sp of the sill plate 16.

As shown in FIG. 1, the sill plate gasket 22 has a nominal thickness t-spg prior to installation. In the illustrated embodiment, the nominal thickness t-spg of the sill plate gasket 22 is 0.25 inches. In another embodiment, the nominal thickness t-spg of the sill plate gasket 22 can be manufactured in a nominal thickness of more or less than 0.25 inches.

Figure 2:
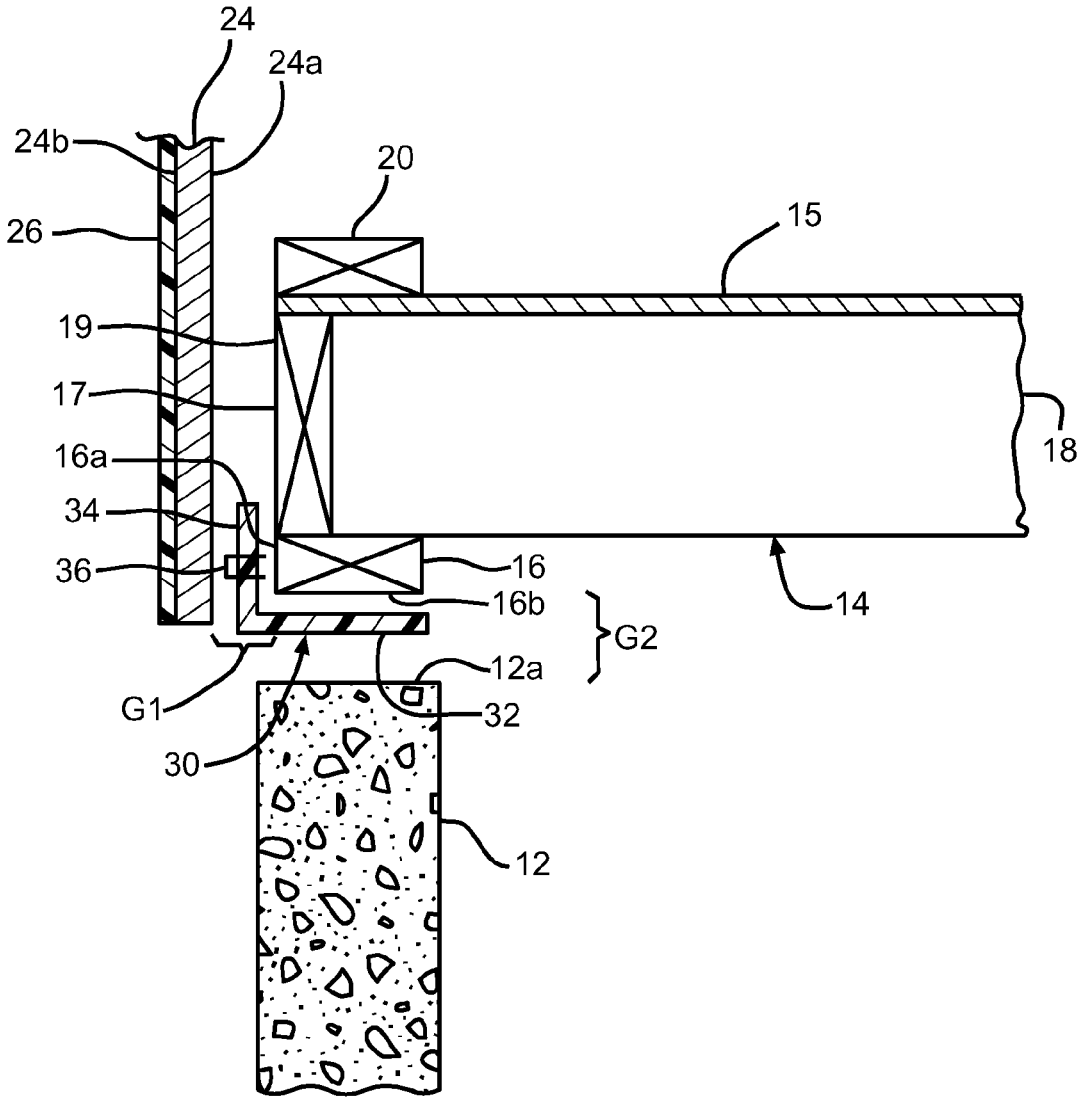
FIG. 2 is a cross-sectional view of a wall construction air barrier system in accordance with this invention.

Referring now to FIG. 2, there is illustrated a first embodiment of a wall construction air barrier system in accordance with this invention. As will be explained below in detail, the wall construction air barrier system is configured to prevent the flow of air in the first gap G1 and the second gap G2.

As shown in FIG. 2, the frame structure 14 is attached to the foundation 12 as described in FIG. 1. The frame structure 14 includes sill plate 16 as described above. Similarly, the exterior sheathing 24 is attached to the exterior surface 19 of the frame structure 14 as shown in FIG. 1. Gap G1 is formed between the interior surface 24*a* of the exterior sheathing 24 and exterior surface 16*a* of the sill plate 16. Gap G2 is formed between the bottom 16*b* of the sill plate 16 and the top 12*a* of the foundation 12.

As shown in FIG. 2, the wall construction air barrier system includes a continuous sealing gasket 30. The gasket 30 is configured to prevent the flow of air in the first gap G1 and the second gap G2. In the illustrated embodiment, the gasket 30 is made of a polyethylene foam material. In another embodiment, the gasket 30 can be made of other materials sufficient to prevent the flow of air in the first gap G1 and the second gap G2.

Figure 3:
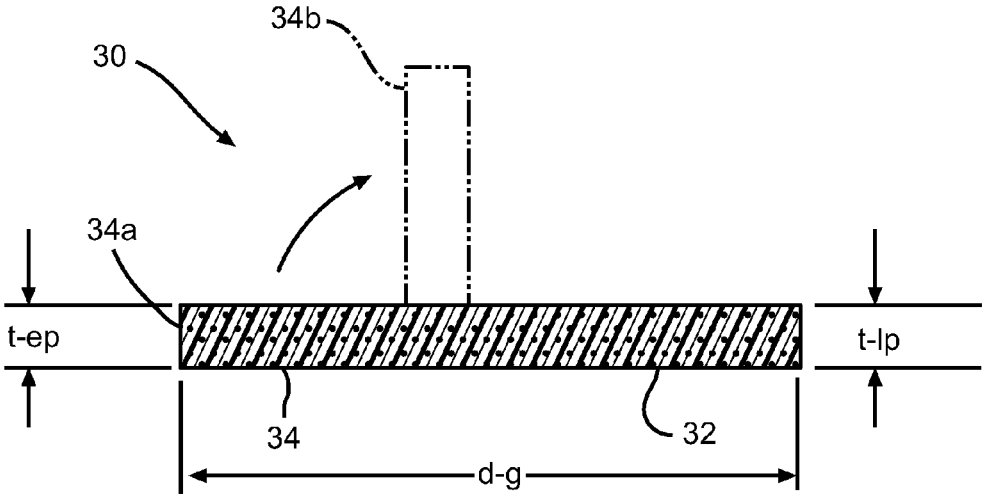
FIG. 3 is a cross-sectional view of a continuous sealing gasket of the wall construction air barrier system of FIG. 2.

Referring now to FIGS. 2 and 3, the continuous sealing gasket 30 has a first or lateral portion 32 and a second or extension portion 34. The term "continuous" as used herein, is defined to mean that the lateral portion 32 and the extension portion 34 are uninterrupted adjacent portions of the same member. This definition also includes an embodiment wherein distinct portions are bonded together to form uninterrupted adjacent portions of the same member. There are several advantages to a sealing gasket having continuous members. First, as will be explained in more detail below, a continuous sealing gasket 30 eliminates a seam between the lateral portion 32 and the extension portion 34. By eliminating a seam, the continuous sealing gasket 30 provides an improved ability to prevent the flow of air in the first gap G1 and the second gap G2. Second, a continuous sealing gasket 30 allows the installation of a single member rather than the installation of two or more separate members, thereby shortening the installation time.

As shown in FIG. 3, the gasket 30 has a width d-g. In the illustrated embodiment, the width d-g is approximately 12 inches. In another embodiment, the width d-g of the gasket 30 can be in a range of from about 6 inches to about 24 inches.

As best shown in FIG. 2, the lateral portion 32 of the gasket 30 is positioned in the second gap G2, between the bottom 16*b* of the sill plate 16 and the top 12*a* of the foundation 12. The lateral portion 32 of the gasket 30 is configured to prevent the flow of air in the second gap G2.

As shown in FIG. 3, the extension portion 34 of the gasket 30 is pivotable from a first position 34*a* to a substantially vertical second position 34*b*. The term "pivot", as used herein, is defined to include other actions, such as for example bending and folding, sufficient to move the extension portion 34 of the gasket 30 from a first position 34*a* to a substantially vertical second position 34*b*, In practice, the extension portion 34 of the continuous sealing gasket 30 is pivoted upward into the substantially vertical second position 34*b* and adjacent to the exterior surface 16*a* of the sill plate 16. The extension portion 34, in the second position 34*b*, is attached to the exterior surface 16*a* of the sill plate 16. In the illustrated embodiment, the extension portion 34 is attached to the exterior surface 16*a* of the sill plate 16 by staples 36. Alternatively, the extension portion 34 can be attached to the exterior surface 16*a* of the sill plate 16 by other suitable fastening methods, such as for example large diameter head nails.

As shown in FIG. 2, the exterior sheathing 24 is attached to the frame structure 14 as detailed above. As the exterior sheathing 24 is attached to the frame structure 14, the extension portion 34, extending from the lateral portion 32 and pivoted to attach to the surface 16*a* of the sill plate 16, fills the first gap G1 between the interior surface 24*a* of the exterior sheathing 24 and the exterior surface 19 of the frame structure 14. Similarly, the positioning of the lateral portion 32 of the continuous sealing gasket 30 in the second gap G2 prevents the flow of air between the bottom 16*b* of the sill plate 16 and the top 12*a* of the foundation 12.

Referring again to FIG. 3, the continuous sealing gasket 30 has lateral and extension portions, 32 and 34. The lateral portion 32 has a thickness t-lp, and extension portion 34 has a thickness t-ep. In the illustrated embodiment, the thickness t-lp of the lateral portion 32 and the thickness t-ep of the extension portion 34 are the same. In another embodiment, the thickness t-lp of the lateral portion 32 and the thickness t-ep can be different. In the illustrated embodiment, the thickness t-lp of the lateral portion 32 is approximately 0.25 inches. In another embodiment, the thickness t-lp can be more or less than 0.25 inches.

As discussed above, the continuous sealing gasket 30 has lateral portion 32 and extension portion 34. In the illustrated embodiment, the lateral portion 32 and the extension portion 34 of the continuous sealing gasket 30 are continuous portions of the same material. In another embodiment, the lateral portion 32 and the extension portion 34 can be different materials joined together prior to installation.

In one embodiment, the sealing gasket 30 can be provided with a fold marking or indicia to improve the alignment of the sealing gasket 30 with respect to the sill plate 16.

Figure 4:
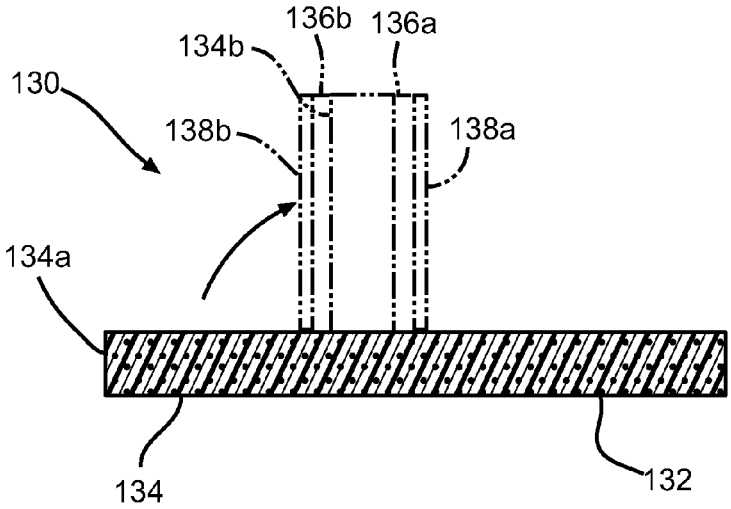
FIG. 4 is a second embodiment of the continuous sealing gasket of FIG. 3.

In another embodiment of the continuous sealing gasket 130 as shown in FIG. 4, the gasket 130 includes lateral portion 132 and extension portion 134. The extension portion 134 is pivotable between a first position 134*a* and a second position 134*b*. The extension portion 134 includes inside adhesive portion 136*a* and outside adhesive portion 136*b*. As the extension portion 134 is pivoted into the second position 134*b*, the inside adhesive portion 136*a* is configured to adhere to the exterior surface of the frame structure. Subsequently, as the exterior sheathing is applied to the frame structure, the outside adhesive portion 136*b* is configured to adhere to the inside surface of the exterior sheathing. In one embodiment, the inside and outside adhesive portions, 136*a* and 136*b*, are made of adhesive caulk. In another embodiment, the inside and outside adhesive portions, 136*a* and 136*b*, are made of other adhesive materials, such as for example double sided tape, sufficient to adhere to the exterior surface of the frame structure and to the inside surface of the exterior sheathing.

Referring again to FIG. 4, the continuous sealing gasket 130 includes inside peel strip 138*a* and outside peel strip 138*b*. The peel strips, 138*a* and 138*b*, are configured to be a protective cover for the adhesive portions, 136*a* and 136*b*, until such time as the continuous sealing gasket 130 is installed. In the illustrated embodiment, the peel strips, 138*a* and 138*b*, are made of thin films of a polymer material. In another embodiment, the peel strips, 138*a* and 138*b*, can be made of other suitable materials.

While the gasket 130 shown in FIG. 4 is illustrated as having an inside and outside adhesive portions, 136*a* and 136*b*, arranged on both sides of the extension portion 134, it should be understood that the sealing gasket 130 can include both adhesive portions, 136*a* and 136*b*, or alternatively a lone adhesive portion arranged on either side of the extension portion 134.

Figure 5:
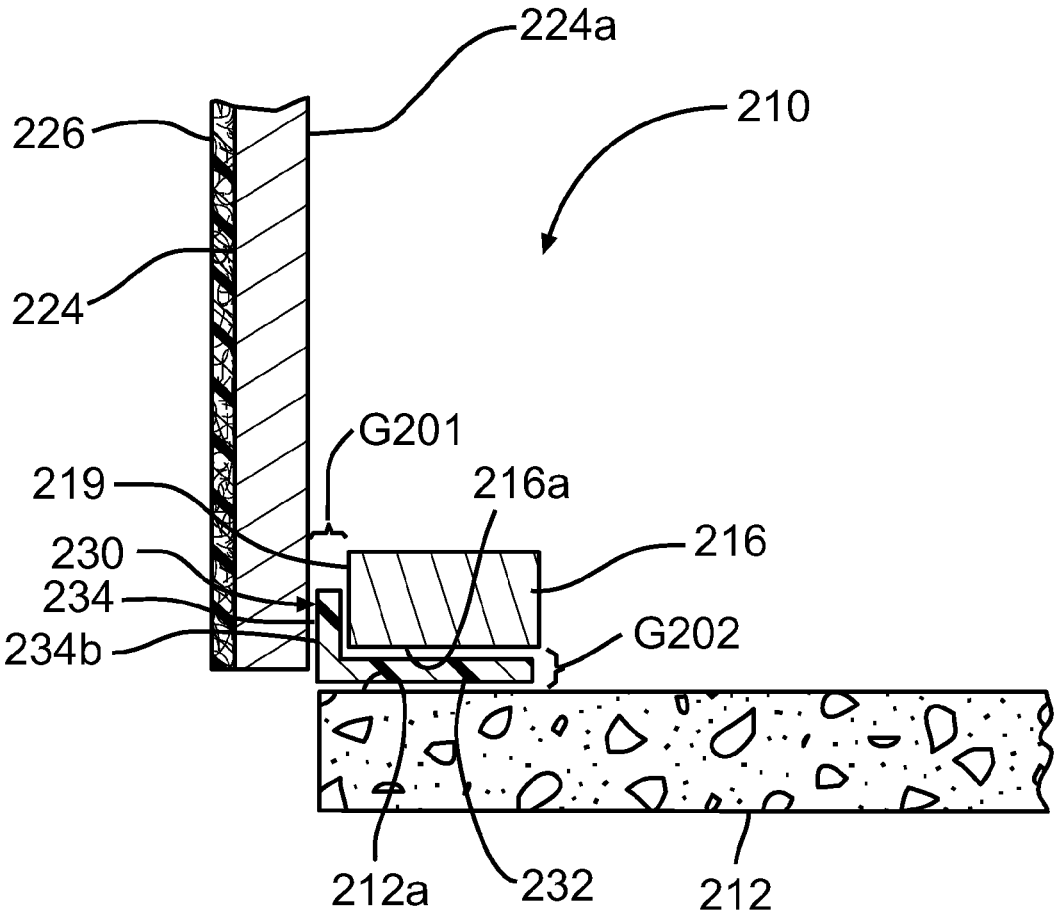
FIG. 5 is a cross-sectional view of a second embodiment of the wall construction air barrier system of FIG. 2.

In other embodiments, the continuous sealing gasket can be used with other construction configurations. One example of another construction configuration is shown in FIG. 5. In this configuration, indicated generally at 210, the floor of the building is built upon a slab foundation 212. In this embodiment, the slab foundation 212 supports a portion of a frame structure. In the embodiment illustrated in FIG. 5 the portion of the frame structure is a sill plate 216. An exterior sheathing 224 and an exterior air barrier 226 are attached as previously described and shown in FIGS. 1 and 2. The slab foundation 212, sill plate 216, exterior sheathing 224 and exterior air barrier 226 can be made of the same materials and configured for the same purposes as illustrated in FIGS. 1 and 2. A continuous sealing gasket 230 having a lateral portion 232 and an extension portion 234 is installed as described in FIG. 2 such that the lateral portion 232 is positioned between a bottom 216*a* of the sill plate 216 and the top 212*a* of the slab foundation 212. The extension portion 234 of the gasket 230 is pivoted into a second substantially vertical position 234*b* and attached to the sill plate 216 as previously described in FIG. 2. As the exterior sheathing 224 is attached, the extension portion 234, extending from the lateral portion 232 and pivoted to attach to the sill plate 216, fills a first gap G201 between an interior surface 224*a* of the exterior sheathing 224 and an exterior surface 219 of the sill plate 216. Similarly, the positioning of the lateral portion 232 of the continuous sealing gasket 230 in a second gap G202 prevents the flow of air between the bottom 216*a* of the sill plate 216 and the top 212*a* of the slab foundation 212.

Figure 6:
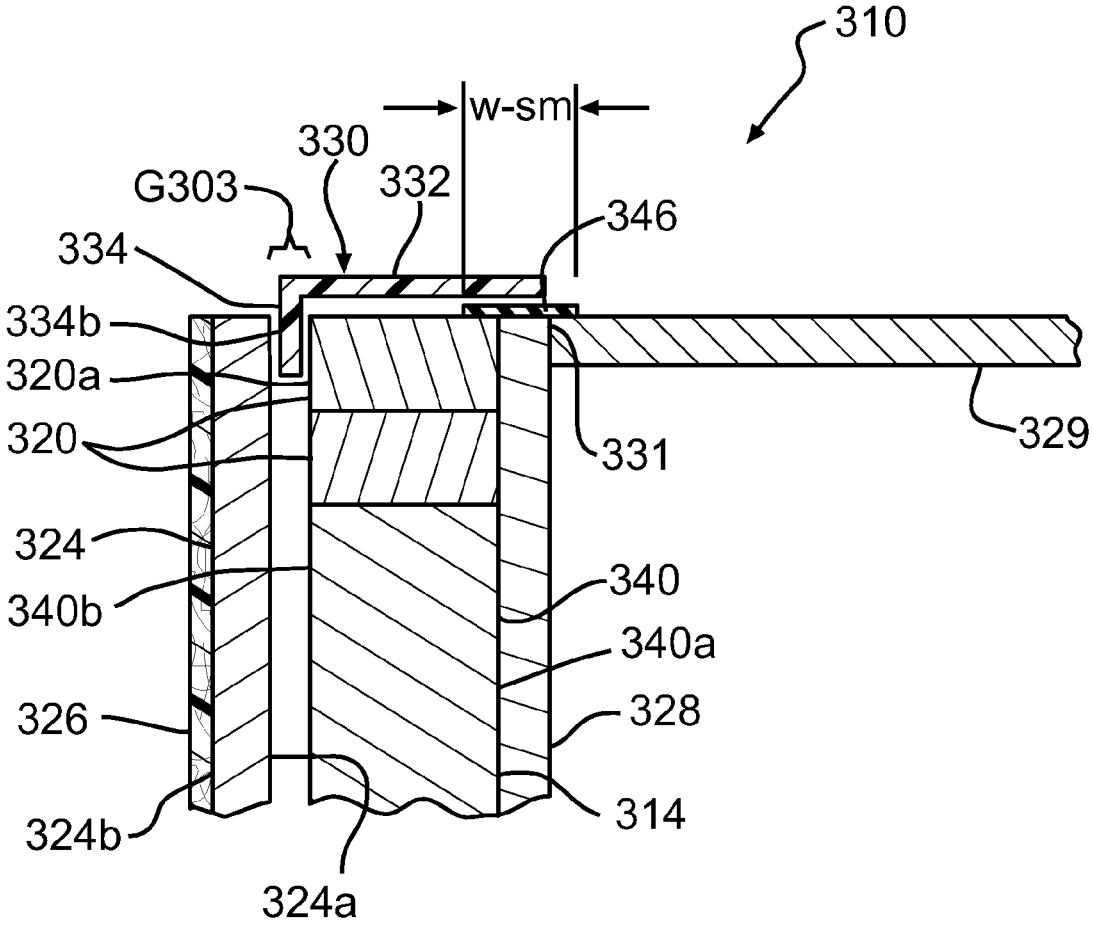
FIG. 6 is a cross-section view of a third embodiment of the wall construction air barrier system of FIG. 2.

Another example of a construction configuration is shown in FIG. 6. In this configuration, indicated generally at 310, the top of a wall is sealed against the flow of air. As shown in FIG. 6, the frame structure 314 includes a plurality of top plates 320 attached to substantially vertical wall studs 340. The top plates 320 are configured in a similar manner as the floor plates 20 of FIG. 1. The top plates 320 have an exterior surface 320*a*. The wall studs 340 have an interior surface 340*a* and an exterior surface 340*b*. Interior panels 328 are attached to the interior surface 340*a* of the wall studs 340. In the illustrated embodiment, the interior panels 328 are made of drywall and are attached to the wall studs 340 using drywall screws. In another embodiment, the interior panels 328 can be made of other materials, such as for example wood paneling, and can be attached to the wall studs 340 using other suitable fasteners, such as for example nails.

Referring again to FIG. 6, exterior sheathing 324 and air barrier 326 are attached to the exterior surface 340*b* of the wall studs 340 as previously described in FIG. 1. The exterior sheathing 324 has an interior surface 324*a* and an exterior surface 324*b*. The intersection between the interior surface 324*a* of the exterior sheathing 324 and exterior surface 320*a* of the top plate 320 defines the gap G303.

As shown in FIG. 6, a continuous sealing gasket 330 is configured to prevent the flow of air in the gap G303. The gasket 330 can be made of the same materials as described in FIG. 2-4. Also as described above, the gasket 330 has a lateral portion 332 and an extension portion 334.

Referring again to FIG. 6, the lateral portion 332 of the gasket 330 is positioned above the top plates 320. The extension portion 334 of the gasket 330 is pivotable from a first position (not shown) to a substantially vertical second position 334*b*. In practice, the extension portion 334 is pivoted downward into the second position 334*b* and adjacent to the exterior surface 320*a* of the top plates 320. The extension portion 334, in the second position 334*b*, is attached to the exterior surface 320*a* of the top plates 320 in the same manner as described in FIG. 2.

As shown in FIG. 6, the exterior sheathing 324 is attached to the exterior surface 340*b* of the wall studs 340 as detailed above. As the exterior sheathing 324 is attached to the wall studs 340, the extension portion 334 fills the gap G303 between the interior surface 324*a* of the exterior sheathing 324 and the exterior surface 340*b* of the wall studs 340. The positioning of the extension portion 334 in gap G303 prevents the flow of air between the interior surface 324*a* of the exterior sheathing 324 and the exterior surface 340*b* of the wall studs 340.

As further shown in FIG. 6, an optional sealing member 346 can be used to seal a joint 331 between ceiling panels 329 and the interior panels 328. The optional sealing member 346 is positioned over the joint 331 and in contact with the top of the top plate 320, the top of the interior panels 328 and the top of the ceiling panels 329. The optional sealing member 346 is configured to prevent the flow of air into the joint 331. The optional sealing member 346 has a width w-sm. As shown in the illustrated embodiment, the width w-sm of the optional sealing member 346 is approximately 2 inches. In another embodiment, the width w-sm of the optional sealing member can be more or less than 2 inches. The optional sealing member 346 is made of sealing material. In the illustrated embodiment, the optional sealing member 346 is made of butyl tape. In another embodiment, the optional sealing member 346 can be made of other sealing materials sufficient to prevent the flow of air into the joint 331.

Figure 7:
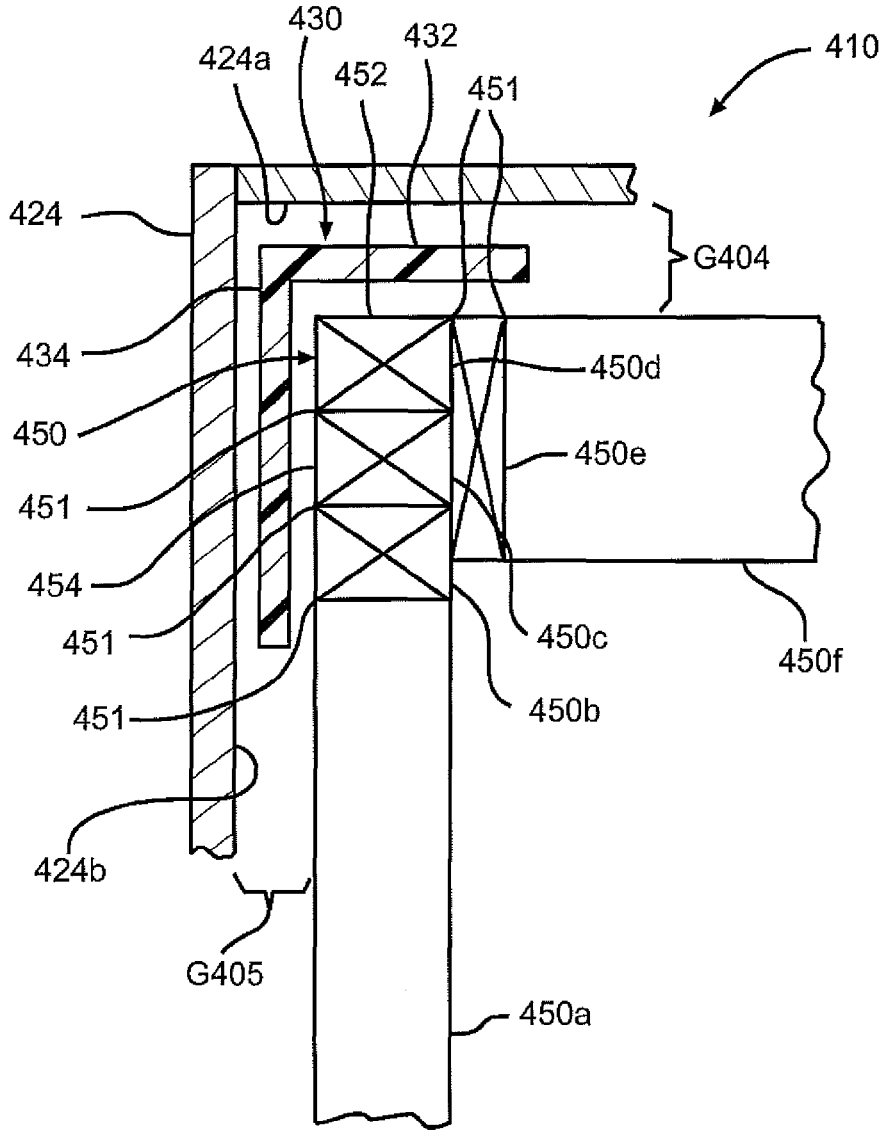
FIG. 7 is a cross-section view of a fourth embodiment of the wall construction air barrier system of FIG. 2.

Another example of a construction configuration is shown in FIG. 7. In this configuration, indicated generally at 410, the corner of a building is sealed against the flow of air. As shown in FIG. 7, an outside building corner 450 is formed by framing members 450*a-f*. The framing members 450*a-f* are configured to form the outside building corner 450 and to support additional construction members. In the illustrated embodiment, the framing members 450*a-f* are made of wood. In another embodiment, the framing members 450*a-f* can be made of other suitable materials. The framing members 450*a-f* can have any suitable thickness, width and height dimensions suitable to form the outside building corner 450 and support additional construction members. The corner 450 has a first outside surface 452 and a second outside surface 454. The intersections formed by adjacent framing members 450*a-f* form seams 451.

As shown in FIG. 7, the corner 450 is covered by exterior sheathing 424. The exterior sheathing 424 can be the same as the exterior sheathing 24 described in FIG. 1. The exterior sheathing has a first inside surface 424*a* and a second inside surface 424*b*. Optionally, the exterior sheathing 424 can be covered by an air barrier (not shown). A first gap G404 is formed between the first inside surface 424*a* of the exterior barrier 424 and the first outside surface 452 of the corner 450. A second gap G405 is formed between the second inside surface 424*b* of the exterior barrier 424 and the second outside surface 454 of the corner 450.

A continuous sealing gasket 430 is positioned in the first gap G404 and the second gap G405. The gasket 430 has a lateral portion 432 and an extension portion 434. The gasket 430 can be the same as the gasket 30 shown in FIG. 2 and is installed using the same methods as described in FIG. 2. In the illustrated embodiment, the gasket 430 is arranged to cover the seams 451 between the adjacent framing members 450*a-f*.

Figure 8:
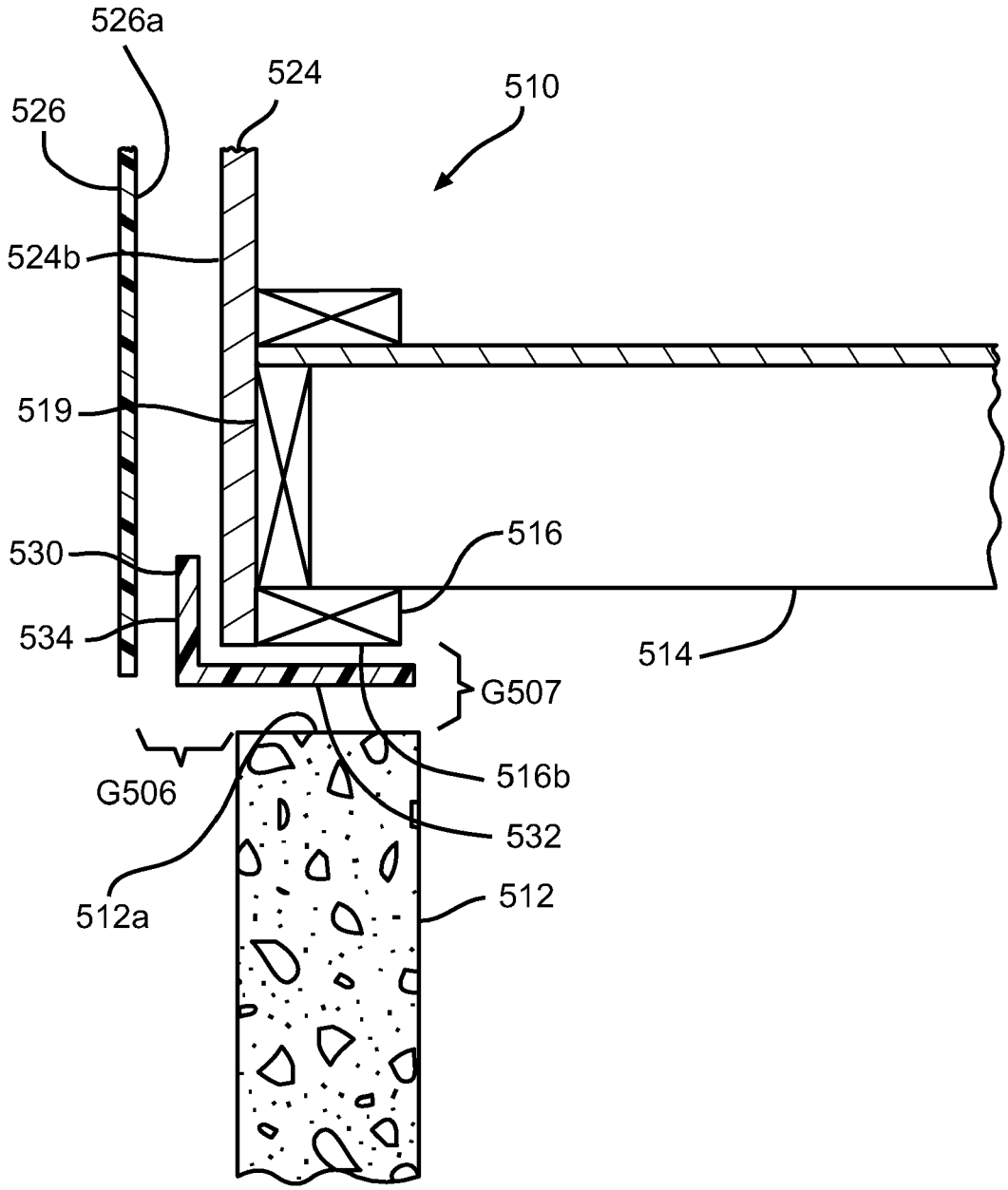
FIG. 8 is a cross-section view of a fifth embodiment of the wall construction air barrier system of FIG. 2.

Referring now to FIG. 8, there is illustrated another embodiment of a wall construction air barrier system, indicated generally at 510 in accordance with this invention. As will be explained below in detail, the wall construction air barrier system 510 is configured to prevent the flow of air in a first gap G506 and a second gap G507.

As shown in FIG. 8, a frame structure 514 is attached to the foundation 512 as described in FIG. 1. The frame structure 514 can be the same frame structure 14 as described in FIG. 1 and includes a sill plate 516 as described above. Similarly, an exterior sheathing 524 is attached to an exterior surface 519 of the frame structure 514 as shown in FIG. 8. Gap G506 is formed between an interior surface 526*a* of an air barrier 526 and the exterior surface 524*b* of the exterior sheathing 524. Gap G507 is formed between a bottom 516*b* of the sill plate 516 and the top 512*a* of the foundation 512.

A continuous sealing gasket 530 is positioned in the gaps G506 and G507. The gasket 530 is configured to prevent the flow of air in the gaps G506 and G507. The gasket 530 can be made of the same materials as the gasket 30 shown in FIG. 2.

Referring again to FIG. 8, the gasket 530 has a lateral portion 532 and an extension portion 534. The extension portion 534 of the gasket 530 is positioned in gap G506 and the lateral portion 532 of the gasket 530 is configured to prevent the flow of air in gap G507. The extension portion 534 of the gasket 30 is pivotable in the same manner as the gasket shown in FIG. 2 and is installed using the same method.

As shown in FIG. 8, the air barrier 526 is attached to the exterior sheathing 524 using any suitable method. As the air barrier 526 is attached to the exterior sheathing 524, the extension portion 534, extending from the lateral portion 532 and pivoted to attach to the exterior surface 524*b* of the exterior sheathing 524, fills the gap G506 between the exterior surface 524*b* of the exterior sheathing 24 and the interior surface 526*a* of the air barrier 526. Similarly, the positioning of the lateral portion 532 of the gasket 530 in gap G507 prevents the flow of air between the bottom 516*b* of the sill plate 516 and the top 512*a* of the foundation 512.

Figure 9:
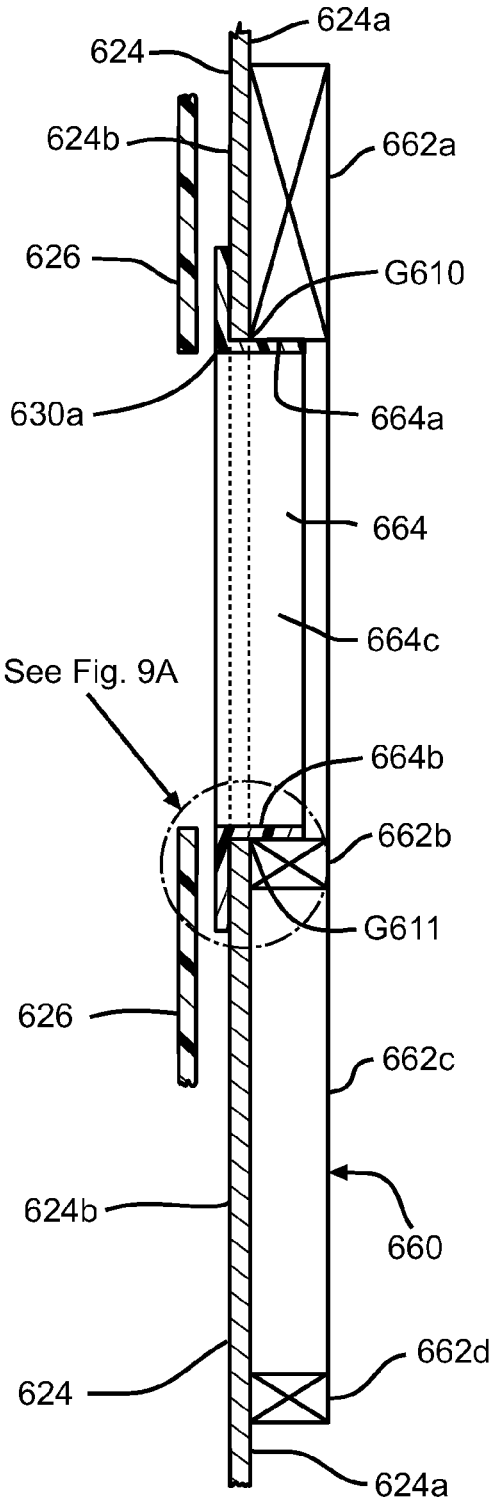
FIG. 9 is a cross-section view of a sixth embodiment of the wall construction air barrier system of FIG. 2.
Figure 9A:
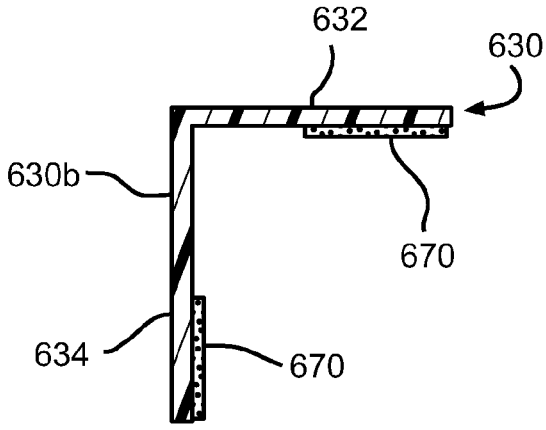
FIG. 9*a* is a cross-section view of the continuous sealing gasket of FIG. 9.

Referring now to FIGS. 9 and 9*a*, there is illustrated another embodiment of a wall construction air barrier system, indicated generally at 610 in accordance with this invention. As will be explained below in detail, the wall construction air barrier system 610 is configured to prevent the flow of air in a plurality of gaps formed by a window pocket within a wall.

As shown in FIG. 9, a wall 660 is formed by framing members 662*a-d*. The framing members 662*a-d* are configured to form the wall 660, to form a rough window opening 664 and to support other construction members. In the illustrated embodiment, the framing members 662*a-d* are made of wood. In another embodiment, the framing members 662*a-d* can be made of other suitable materials. The framing members 662*a-d* can have any suitable thickness, width and height dimensions suitable to form the wall 660, to form a rough window opening 664 and to support additional construction members.

As shown in FIG. 9, the wall 660 includes a rough window opening 664. The term "rough window opening" as used herein, is defined to mean an opening, formed by typical framing members including sills, headers and studs, suitable for a window. The opening 664 has a plurality of inwardly facing interior side surfaces. In the embodiment illustrated in FIG. 9, the opening 664 includes an opening top surface 664*a*, an opening bottom surface 664*b*, a first opening side surface 664*c* and an opposing second opening side surface (not shown).

As shown in FIG. 9, the wall 660 is covered by exterior sheathing 624. The exterior sheathing 624 can be the same as the exterior sheathing 24 described in FIG. 1. The exterior sheathing 624 has an interior surface 624*a* and an exterior surface 624*b*.

A first gap G610 is formed between the top opening 664*a* of the opening 664 and the interior surface 624*a* of the exterior sheathing 624. A second gap G611 is formed between the opening bottom 664*b* of the opening 664 and the interior surface 624*a* of the exterior sheathing 624. Similarly, a gap (not shown) is formed between the first opening side 664*c* and the interior surface 624*a* of the exterior sheathing 624. Another gap (not shown) is formed between the second opening side and the interior surface 624*a* of the exterior sheathing 624.

The exterior sheathing 624 can be covered by an optional air barrier 626. The optional air barrier 626 can be the same as the air barrier illustrated in FIG. 1.

A first continuous sealing gasket 630*a* is positioned to cover the first gap G610. A second continuous sealing gasket 630*b* is positioned to cover the second gap G611. Similarly, a third continuous sealing gasket (not shown) is positioned to cover the gap formed between the first opening side 664*c* and the interior surface 624*a* of the exterior sheathing 624. Another continuous sealing gasket (not shown) is positioned to cover the gap formed between the second opening side and the interior surface 624*a* of the exterior sheathing 624.

As shown in FIG. 9*a*, the gaskets 630*a* and 630*b* have a lateral portion 632 and an extension portion 634. The gasket 630 is the same as the gasket 30 shown in FIG. 4 and is shown having a plurality of optional adhesive portions 670. The adhesive portions 670 are the same as the adhesive portions, 136*a* and 136*b*, shown in FIG. 4. The gaskets 630*a* and 630*b* are installed using the same methods as described in FIG. 2. In the illustrated embodiment, the gaskets 630*a* and 630*b* are arranged to cover the gaps G610, G611, and the gaps formed between the opposing sides and the interior surface 624*a* of the exterior sheathing 624.

The principle and mode of operation of this invention have been described in its preferred embodiments. However, it should be noted that this invention can be practiced otherwise than as specifically illustrated and described without departing from its scope.

What is claimed is:

1. A method of constructing a wall air barrier system, the method including the steps of:

providing a continuous sealing gasket formed from a single layer of substantially uniform material and defining a first portion and a second portion;

positioning the first portion of the sealing gasket on a building foundation;

pivoting the first portion of the sealing gasket relative to the second portion of the sealing gasket;

positioning the second portion of the sealing gasket on a building frame such that the second portion of the sealing gasket directly abuts the building frame;

attaching a portion of the building frame adjacent to the building foundation such that a gap is defined between the building foundation and the portion of the frame and that the first portion of the continuous sealing gasket is in the gap defined between the portion of the building frame and the building foundation, wherein the continuous sealing gasket prevents the flow of air in the gap defined between the portion of the frame and the building foundation; and attaching at least one exterior sheathing to the building frame such that the second portion of the sealing gasket is between the exterior sheathing and the building frame.

2. The method of claim 1 further including attaching the second portion of the continuous sealing gasket to a portion of the frame by stapling.

3. The method of claim 1, wherein the sealing gasket is made of polyethylene foam.

4. A wall construction air barrier system comprising:

a foundation;

a portion of a frame positioned on top of and adjacent the foundation, wherein a gap is defined between the foundation and the portion of the frame;

at least one of an exterior sheathing and an air barrier attached to the frame; and a continuous sealing gasket formed from a single layer of substantially uniform material and defining a first portion positioned in the gap defined between the portion of the frame and the foundation and a second portion positioned between the portion of the frame and the exterior sheathing, the second portion directly abutting the portion of the frame wherein the continuous sealing gasket prevents the flow of air in the gap defined between the portion of the frame and the foundation.

5. The wall construction air barrier system of claim 4, wherein the second portion of the continuous sealing gasket is attached to an exterior surface of the portion of the frame.

6. The wall construction air barrier system of claim 5, wherein the second portion of the continuous sealing gasket is attached to the exterior surface of the portion of the frame by stapling.

7. The wall construction air barrier system of claim 4, wherein the continuous sealing gasket is made of polyethylene foam.

8. The wall construction air barrier system of claim 4, wherein the second portion of the continuous sealing gasket is configured so that it can pivot from a first position to a substantially vertical second position.

9. The wall construction air barrier system of claim 4, wherein the first portion of the continuous sealing gasket has a pre-installation thickness of about 0.25 inches.

10. The wall construction air barrier system of claim 9, wherein the second portion of the continuous sealing gasket has a thickness equal to the thickness of the first portion of the continuous sealing gasket.

11. The wall construction air barrier system of claim 4, wherein the portion of a frame includes a sill plate.

12. A continuous sealing gasket for a wall construction air barrier system in a building, the continuous sealing gasket comprising:

a continuous sealing gasket body formed from a single layer of substantially uniform material and defining a first sealing gasket portion and a second sealing gasket portion;

wherein the first sealing gasket portion is positioned in a gap defined between a first portion of a building frame and one of a building foundation, an exterior sheathing, and an air barrier, the first sealing gasket portion directly abutting the first portion of the building frame; and wherein the second sealing gasket portion is positioned in a gap defined between a second portion of the building frame and one of the building foundation, the exterior sheathing, and the air barrier, the second sealing gasket portion directly abutting the second portion of the building frame, wherein the continuous sealing gasket prevents the flow of air in the gaps defined between the portions of the building frame and the one of the building foundation, the exterior sheathing, and the air barrier.

13. A wall construction air barrier system comprising:

a foundation;

a portion of a frame positioned on top of and adjacent the foundation, wherein a gap is defined between the foundation and the portion of the frame;

at least one of an exterior sheathing and an air barrier attached to the frame; and a continuous sealing gasket formed from a single layer substantially uniform of material and defining a first portion positioned in the gap defined between the portion of the frame and the foundation and a second portion positioned between the portion of the frame and the exterior sheathing, the second portion directly abutting the portion of the frame;

wherein the first portion and the second portion of the continuous sealing gasket have the same thickness, and wherein the continuous sealing gasket prevents the flow of air in the gap defined between the portion of the frame and the foundation and in the gap defined between the portion of the frame and the exterior sheathing.

* * * * *